US012584204B2

(12) United States Patent
Hirai et al.

(10) Patent No.: US 12,584,204 B2
(45) Date of Patent: Mar. 24, 2026

(54) STEEL WIRE

(71) Applicant: Sumitomo Electric Industries, Ltd., Osaka (JP)

(72) Inventors: Kei Hirai, Osaka (JP); Tetsuya Nakajima, Osaka (JP); Akifumi Matsuoka, Osaka (JP); Takumi Akada, Osaka (JP)

(73) Assignee: Sumitomo Electric Industries, Ltd.

( * ) Notice: Subject to any disclaimer, the term of this patent is extended or adjusted under 35 U.S.C. 154(b) by 10 days.

(21) Appl. No.: 18/729,328

(22) PCT Filed: Feb. 2, 2023

(86) PCT No.: PCT/JP2023/003418
§ 371 (c)(1),
(2) Date: Jul. 16, 2024

(87) PCT Pub. No.: WO2023/162615
PCT Pub. Date: Aug. 31, 2023

(65) Prior Publication Data

US 2025/0092495 A1 Mar. 20, 2025

(30) Foreign Application Priority Data

Feb. 22, 2022 (JP) ..... 2022-025608

(51) Int. Cl.
*C22C 38/18* (2006.01)
*B21C 1/02* (2006.01)
(Continued)

(52) U.S. Cl.
CPC ..... *C22C 38/18* (2013.01); *B21C 1/02* (2013.01); *B21C 37/045* (2013.01);
(Continued)

(58) Field of Classification Search
CPC ..... C22C 38/00; C22C 38/02; C22C 38/04; C22C 38/32; C22C 38/18; B21C 1/02;
(Continued)

(56) References Cited

U.S. PATENT DOCUMENTS 5,248,353 A * 9/1993 Nishida ..... C21D 8/06 148/599
5,725,689 A 3/1998 Nishida et al.
(Continued)

FOREIGN PATENT DOCUMENTS

JP 06-312210 A 11/1994
JP 08-295932 A 11/1996
(Continued)

*Primary Examiner* — Michael E. La Villa
(74) *Attorney, Agent, or Firm* — Volpe Koenig

(57) ABSTRACT

A steel wire is composed of a steel containing not less than 1.0 mass % and not more than 1.1 mass % C, not less than 0.15 mass % and not more than 0.25 mass % Si, not less than 0.25 mass % and not more than 0.35 mass % Mn, and not less than 0.15 mass % and not more than 0.25 mass % Cr, with the balance being Fe and unavoidable impurities. The steel wire has a wire diameter of not less than 0.15 mm and not more than 0.42 mm. The steel has a pearlite structure. The steel has a dislocation density of not less than $2.4\times10^{16}$ $m^{-2}$ and not more than $5.0\times10^{16}$ $m^{-2}$. The steel has a full width at half maximum in a circumferential direction of not less than 42° at a peak of a maximum intensity of a Debye ring for Fe (211) plane.

10 Claims, 2 Drawing Sheets

(51) Int. Cl.

| | |
|---|---|
| ***B21C 37/04*** | (2006.01) |
| ***C22C 38/00*** | (2006.01) |
| ***C22C 38/02*** | (2006.01) |
| ***C22C 38/04*** | (2006.01) |
| ***C22C 38/32*** | (2006.01) |

(52) U.S. Cl.
CPC ..... *B21C 37/047* (2013.01); *C22C 38/00* (2013.01); *C22C 38/02* (2013.01); *C22C 38/04* (2013.01); *C22C 38/32* (2013.01); *C21D 2211/009* (2013.01)

(58) Field of Classification Search
CPC ..... B21C 37/045; B21C 37/047; C21D 2211/009
See application file for complete search history.

(56) References Cited

U.S. PATENT DOCUMENTS

| | | | |
|---|---|---|---|
| 2009/0087336 | A1 | 4/2009 | Nishida et al. |
| 2012/0014831 | A1 | 1/2012 | Yamasaki et al. |
| 2017/0009317 | A1 | 1/2017 | Hirakami et al. |

FOREIGN PATENT DOCUMENTS

| | | | |
|---|---|---|---|
| JP | 2019-056162 | A | 4/2019 |
| WO | 95/026422 | A1 | 10/1995 |
| WO | 2007/139234 | A1 | 12/2007 |
| WO | 2011/092905 | A1 | 8/2011 |
| WO | 2015/119241 | A1 | 8/2015 |

* cited by examiner

STEEL WIRE

TECHNICAL FIELD

The present disclosure relates to a steel wire.

The present application claims priority based on Japanese Patent Application No. 2022-25608 filed on Feb. 22, 2022, the entire contents of which are incorporated herein by reference.

BACKGROUND ART

A steel wire containing a pearlite structure can be used, for example, as steel wires constituting a steel cord. In the production of a steel cord, a plurality of steel wires are stranded together. Therefore, a steel wire used for such applications is required to have not only tensile strength but also toughness from the standpoint of suppressing wire breakage during stranding. A technique relating to a steel wire that aims to achieve both tensile strength and toughness has been proposed (see, for example, Japanese Patent Application Laid-Open No. 2019-56162 (Patent Literature 1)).

CITATION LIST

Patent Literature

Patent Literature 1: Japanese Patent Application Laid-Open No. 2019-56162

SUMMARY OF INVENTION

A steel wire according to the present disclosure is composed of a steel containing: not less than 1.0 mass % and not more than 1.1 mass % C (carbon), not less than 0.15 mass % and not more than 0.25 mass % Si (silicon), not less than 0.25 mass % and not more than 0.35 mass % Mn (manganese), and not less than 0.15 mass % and not more than 0.25 mass % Cr (chromium), with the balance being Fe (iron) and unavoidable impurities. The steel wire of the present disclosure has a wire diameter of not less than 0.15 mm and not more than 0.42 mm. The steel has a pearlite structure. The steel has a dislocation density of not less than $2.4\times10^{16}$ $m^{-2}$ and not more than $5.0\times10^{16}$ $m^{-2}$. The steel has a full width at half maximum in a circumferential direction of not less than 42° at a peak of a maximum intensity of a Debye ring for Fe (211) plane.

DESCRIPTION OF EMBODIMENTS

Figure 1:
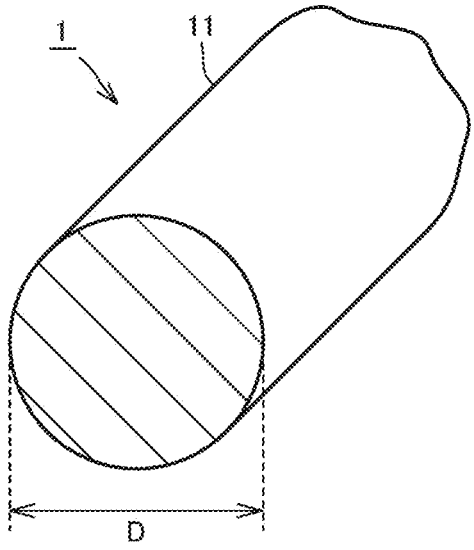
FIG. 1 is a schematic perspective view showing the structure of a steel wire.

Problems to be Solved by Present Disclosure

As described above, there are cases where a steel wire is required to have both tensile strength and toughness. One of the objects of the present disclosure is to provide a steel wire capable of achieving both high tensile strength and high toughness.

Advantageous Effects of Present Disclosure

According to the steel wire of the present disclosure, both high tensile strength and high toughness can be achieved.

Description of Embodiments of Present Disclosure

Embodiments of the present disclosure will be first listed and described. A steel wire of the present disclosure is composed of a steel containing: not less than 1.0 mass % and not more than 1.1 mass % C, not less than 0.15 mass % and not more than 0.25 mass % Si, not less than 0.25 mass % and not more than 0.35 mass % Mn, and not less than 0.15 mass % and not more than 0.25 mass % Cr, with the balance being Fe and unavoidable impurities. The steel wire of the present disclosure has a wire diameter of not less than 0.15 mm and not more than 0.42 mm. The steel has a pearlite structure. The steel has a dislocation density of not less than $2.4\times10^{16}$ $m^{-2}$ and not more than $5.0\times10^{16}$ $m^{-2}$. The steel has a full width at half maximum in a circumferential direction of not less than 42° at a peak of a maximum intensity of a Debye ring for Fe (211) plane.

Increasing the degree of working (reduction of area) in a wire drawing step during the production of a steel wire can increase the strength of the steel wire. However, this is accompanied by a decrease in the toughness of the steel wire.

According to studies conducted by the present inventors, in the production of a steel wire composed of a steel having a pearlite structure, even in the case where the degree of working in the wire drawing step is increased to raise the dislocation density to thereby increase the tensile strength, high toughness can be ensured by suppressing the increase of crystal orientation in the steel constituting the steel wire. Specifically, in the steel wire of the present disclosure, despite the high dislocation density value of $2.4\times10^{16}$ $m^{-2}$ or more and $5.0\times10^{16}$ $m^{-2}$ or less, the Debye ring for Fe (211) plane of the steel constituting the steel wire has a full width at half maximum in the circumferential direction of 42° or more at the peak of the maximum intensity. Accordingly, the steel wire of the present disclosure can ensure excellent toughness despite the high tensile strength. Thus, according to the steel wire of the present disclosure, both high tensile strength and high toughness can be achieved.

As used herein, the "wire diameter" means the diameter of a circle that has the same area as the cross section perpendicular to the longitudinal direction of the steel wire. The shape of the cross section of the steel wire perpendicular to the longitudinal direction is not particularly limited, and any shape can be adopted. For example, the shape of the cross section of the steel wire perpendicular to the longitudinal direction is circular. In this case, the "wire diameter" means the diameter of the cross section perpendicular to the longitudinal direction of the steel wire.

In the above steel wire, the full width at half maximum may be not less than 60° and not more than 90°. Setting the full width at half maximum to 60° or more makes it easier to ensure high toughness. Setting the full width at half maximum to 90° or less allows high dislocation density and facilitates obtaining high tensile strength.

In the above steel wire, the dislocation density may be not less than $3.0\times10^{16}$ $m^{-2}$ and not more than $5.0\times10^{16}$ $m^{-2}$. Setting the dislocation density to $3.0\times10^{16}$ $m^{-2}$ or more makes it easier to ensure high tensile strength. Setting the dislocation density to $5.0\times10^{16}$ $m^{-2}$ or less facilitates ensuring high toughness by suppressing the crystal orientation.

In the above steel wire, the wire diameter may be not less than 0.15 mm and not more than 0.18 mm, and the tensile strength may be not less than 4240 MPa and not more than 4900 MPa.

In the above steel wire, the wire diameter may be not less than 0.18 mm and not more than 0.21 mm, and the tensile strength may be not less than 4180 MPa and not more than 4740 MPa.

In the above steel wire, the wire diameter may be not less than 0.21 mm and not more than 0.30 mm, and the tensile strength may be not less than 4000 MPa and not more than 4580 MPa.

The above combinations of the wire diameter and the tensile strength achieve sufficient tensile strength for each wire diameter. Tensile strength can be measured according to JIS (Japanese Industrial Standards) Z 2241, for example.

The reasons for limiting the component composition of the steel constituting the steel wire to the above-described ranges will now be described.

C: Not Less than 1.0 Mass % and not More than 1.1 Mass %

C is an element that greatly affects the strength of the steel wire having a pearlite structure. From the standpoint of obtaining sufficient tensile strength as a steel wire, the C content is necessary to be 1.0 mass % or more. An increased C content reduces toughness. From the standpoint of ensuring sufficient toughness, the C content is necessary to be 1.1 mass % or less. From the standpoint of improving the toughness, the C content is preferably 1.05 mass % or less.

Si: Not Less than 0.15 Mass % and not More than 0.25 Mass %

Si is an element that serves as a deoxidizing agent in steel refining. Si also increases the strength of ferrite in the pearlite structure. From the standpoint of ensuring high tensile strength, the Si content is necessary to be 0.15 mass % or more. An increased Si content may reduce toughness. From the standpoint of ensuring sufficient toughness, the Si content is necessary to be 0.25 mass % or less.

Mn: Not Less than 0.25 Mass % and not More than 0.35 Mass %

Mn, as with Si, is an element that serves as a deoxidizing agent in steel refining. In order to sufficiently achieve the effect as the deoxidizing agent, the manganese content is necessary to be 0.25 mass % or more. If the added amount of Mn becomes large, in the case where patenting is performed before the wire drawing step, a martensitic structure would likely be generated during cooling after heating. The martensitic structure thus generated will degrade workability at the time of wire drawing. Thus, the Mn content is necessary to be 0.35 mass % or less.

Cr: Not Less than 0.15 Mass % and not More than 0.25 Mass %

Cr contributes to increased tensile strength of a steel wire. From the standpoint of ensuring high tensile strength, the Cr content is necessary to be 0.15 mass % or more. Addition of Cr will increase the raw material cost. From the standpoint of reducing the raw material cost, the Cr content is necessary to be 0.25 mass % or less.

Unavoidable Impurities

In the process of producing a steel wire, P (phosphorus), S (sulfur), and others are inevitably mixed into the steel constituting the steel wire as unavoidable impurities. P and S present in excessive amounts will cause grain boundary segregation and produce inclusions, thereby degrading the properties of the steel. Therefore, the P content and the S content are each preferably not more than 0.025 mass %. The total content of the unavoidable impurities, including P and S, is preferably not more than 0.3 mass %.

Details of Embodiments of Present Disclosure

An embodiment of the steel wire according to the present disclosure will be described below with reference to the drawings. In the drawings referenced below, the same or corresponding portions are denoted by the same reference numerals and the description thereof will not be repeated.

FIG. 1 is a schematic perspective view showing the structure of a steel wire. In FIG. 1, a cross section of the steel wire perpendicular to the longitudinal direction is also illustrated. Referring to FIG. 1, the steel wire 1 in the present embodiment is a steel wire that has a circular cross section perpendicular to the longitudinal direction and has an outer peripheral surface 11 of a cylindrical surface shape. The steel wire 1 has a wire diameter D of not less than 0.15 mm and not more than 0.42 mm. The cross section of the steel wire 1 perpendicular to the longitudinal direction may be other than circular; for example, it may be elliptical.

The steel wire 1 is composed of a steel that contains not less than 1.0 mass % and not more than 1.1 mass % C, not less than 0.15 mass % and not more than 0.25 mass % Si, not less than 0.25 mass % and not more than 0.35 mass % Mn, and not less than 0.15 mass % and not more than 0.25 mass % Cr, with the balance being Fe and unavoidable impurities. The steel constituting the steel wire 1 has a pearlite structure. The steel constituting the steel wire 1 has a dislocation density of not less than $2.4\times10^{16}$ $m^{-2}$ and not more than $5.0\times10^{16}$ $m^{-2}$. The steel constituting the steel wire 1 has a full width at half maximum in a circumferential direction of not less than 42° at a peak of a maximum intensity of a Debye ring for Fe (211) plane.

The dislocation density of the steel constituting the steel wire 1 can be measured using, for example, a synchrotron radiation XRD (X-ray diffractometer). The full width at half maximum in the circumferential direction at the peak of the maximum density of the Debye ring for Fe (211) plane of the steel constituting the steel wire 1 can be obtained, for example, by acquiring the entire circumference of the Debye ring for Fe (211) plane in two dimensions using XRD and calculating the full width at half maximum in the circumferential direction at the peak of the maximum intensity.

Figure 2:
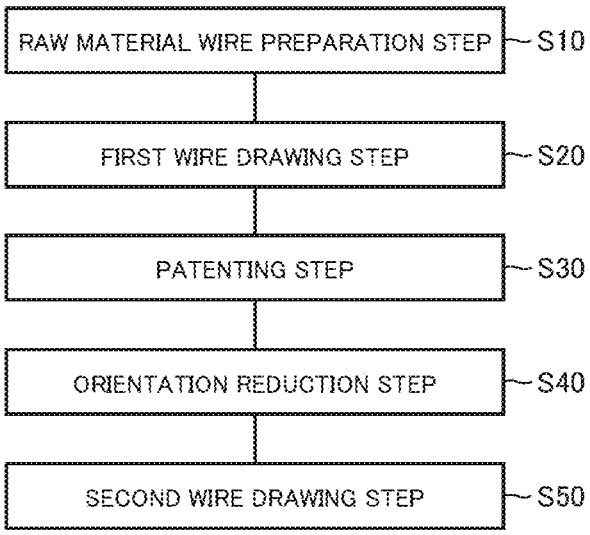
FIG. 2 is a flowchart illustrating an outline of a method of producing a steel wire.

An example of the method of producing the steel wire 1 will now be described. Referring to FIG. 2, in the method of producing the steel wire 1 in the present embodiment, firstly, a raw material wire preparation step is performed as step S10. In step S10, a raw material wire composed of a steel containing not less than 1.0 mass % and not more than 1.1 mass % C, not less than 0.15 mass % and not more than 0.25 mass % Si, not less than 0.25 mass % and not more than 0.35 mass % Mn, and not less than 0.15 mass % and not more than 0.25 mass % Cr, with the balance being Fe and unavoidable impurities, is prepared. The raw material wire may have a wire diameter of, for example, not less than 4 mm and not more than 6 mm.

Next, a first wire drawing step is performed as step S20. In step S20, the raw material wire prepared in step S10 is subjected to drawing. In the present embodiment, the drawing is performed such that the raw material wire obtains a wire diameter of, for example, not less than 1 mm and not more than 2 mm in step S20.

Next, a patenting step is performed as step S30. In this step S30, the raw material wire that has undergone drawing in step S20 is subjected to patenting. Specifically, firstly, the raw material wire is heated to a temperature range not lower than the temperature at which the steel constituting the wire is austenitized (temperature range of Acm point or higher), which is, for example, a temperature range of not lower than 950° C. and not higher than 1000° C., and held for a period of not shorter than five seconds and not longer than ten seconds (austenitizing treatment). Thereafter, the raw material wire is rapidly cooled to a temperature range higher than the temperature at which martensitic transformation of the steel starts (temperature range of MS point or higher), which is, for example, a temperature range of not lower than 500° C. and not higher than 600° C., and held at this temperature range (isothermal transformation treatment). With this, the metallographic structure of the raw material wire becomes a fine pearlite structure. In the above austenitizing treatment, the raw material wire may be heated in an inert gas atmosphere from the standpoint of suppressing the occurrence of decarburization.

Next, an orientation reduction step is performed as step S40. In this step S40, the raw material wire that has undergone drawing in step S20 and patenting in step S30 is subjected to heat treatment. Specifically, in step S40, heat treatment of heating the raw material wire to a temperature range of not lower than 600° C. and not higher than 665° C. and holding the same for a period of not shorter than five seconds and not longer than ten seconds is performed. This heat treatment reduces the orientation of the steel.

Next, a second wire drawing step is performed as step S50. In this step S50, the raw material wire that has undergone patenting in step S30 and the orientation reduction process in step S40 is subjected to drawing. In the present embodiment, the drawing is performed such that the raw material wire obtains a wire diameter of not less than 0.15 mm and not more than 0.42 mm in step S50. The steel wire of the present embodiment is completed through the above steps.

In the steel wire production method of the present embodiment, the heat treatment is conducted in step S40 to reduce the orientation of the steel. In this step S40, appropriate temperature and hold time are adopted to suppress the decrease of the dislocation density while reducing the orientation of the steel. Then, with the wire drawing performed in step S50, the dislocation density increases, and high tensile strength is obtained. At this time, although the orientation of the steel is increased by the wire drawing in step S50, the orientation has been reduced in step S40, so the orientation of the steel becomes lower than in the case where step S40 is not performed. As a result, it is possible to achieve the full width at half maximum in the circumferential direction of 42° or more at the peak of the maximum intensity of the Debye ring for Fe (211) plane, while achieving the dislocation density of $2.4\times10^{16}$ $m^{-2}$ or more and $5.0\times10^{16}$ $m^{-2}$ or less.

In the steel wire 1 of the present embodiment, despite the high dislocation density value of $2.4\times10^{16}$ $m^{-2}$ or more and $5.0\times10^{16}$ $m^{-2}$ or less, the Debye ring for Fe (211) plane of the steel constituting the steel wire has the full width at half maximum in the circumferential direction of 42° or more at the peak of the maximum intensity. This makes the steel wire 1 to be a steel wire that achieves both high tensile strength and high toughness. With the high toughness, the steel wire 1 can suppress wire breakage during the stranding process. Therefore, the steel wire 1 is suitable as a steel wire constituting a high-strength steel cord.

In the present embodiment, the full width at half maximum is preferably not less than 60° and not more than 90°. Setting the full width at half maximum to 60° or more makes it easier to ensure high toughness. Setting the full width at half maximum to 90° or less allows high dislocation density and facilitates obtaining high tensile strength.

In the present embodiment, the dislocation density is preferably not less than $3.0\times10^{16}$ $m^{-2}$ and not more than $5.0\times10^{16}$ $m^{-2}$. Setting the dislocation density to $3.0\times10^{16}$ $m^{-2}$ or more makes it easier to ensure high tensile strength. Setting the dislocation density to $5.0\times10^{16}$ $m^{-2}$ or less facilitates ensuring high toughness by suppressing the crystal orientation.

In the present embodiment, the wire diameter D may be not less than 0.15 mm and not more than 0.18 mm, and the tensile strength may be not less than 4240 MPa and not more than 4900 MPa. The wire diameter D may be not less than 0.18 mm and not more than 0.21 mm, and the tensile strength may be not less than 4180 MPa and not more than 4740 MPa. The wire diameter D may be not less than 0.21 mm and not more than 0.30 mm, and the tensile strength may be not less than 4000 MPa and not more than 4580 MPa. The above combinations of the wire diameter D and the tensile strength achieve sufficient tensile strength for each wire diameter D.

EXAMPLES

Experiments were conducted to confirm that the steel wire 1 of the present disclosure above can achieve both high tensile strength and high toughness. Experimental procedures were as follows.

(1) Relationship Between Dislocation Density and Tensile Strength

Two types of raw material wires (raw material wires A and B) composed of steels having different C contents were prepared, and steel wires were produced with the same procedure as in the above embodiment. The component compositions of the steels constituting the raw material wires are shown in Table 1. Raw material wires with circular cross sections and wire diameters of 4.0 mm and 5.5 mm were prepared, which were drawn in the first wire drawing step to have wire diameters of 1.3 mm and 1.5 mm. Next, the wires were heated to 980° C. and held for eight seconds, and then rapidly cooled to 580° C. for patenting. Subsequently, heat treatment was conducted in which the wires were heated to 640° C. and held for eight seconds to reduce the orientation. Thereafter, copper plating and zinc plating were conducted, and then copper and zinc were diffused into each other to form a brass-plated layer with a thickness of 2 μm. The wires were then drawn in the second wire drawing step to obtain steel wires (element wires) having a wire diameter of 0.21 mm. The reductions of area at this time were 97% and 98%. Steel wires having different dislocation densities due to different reductions of area were obtained. Here, the reduction of area, r, is defined by the following expression (1), where the cross-sectional area before drawing is $S_0$ and the cross-sectional area after drawing is $S_1$ in the cross section perpendicular to the longitudinal direction of a wire (steel wire).

$$r=\{(S_0-S_1)/S_0\}\times100(\%) \quad (1)$$

TABLE 1

| | C | Si | Mn | Cr | Fe |
|---|---|---|---|---|---|
| A | 1.05 | 0.20 | 0.30 | 0.20 | Bal. |
| B | 0.90 | 0.25 | 0.35 | 0.20 | Bal. |

For the steel wires thus obtained, dislocation density was measured and tensile strength was investigated. The dislocation density was measured in the following manner. Firstly, about 20 steel wires produced in the above-described manner were arranged side by side from the standpoint of increasing the X-ray irradiation area to form a specimen, and this specimen was irradiated with X rays. Then, line profiles of diffraction peaks for (110) plane, (200) plane, (211) plane, (220) plane, and (310) plane of iron were obtained. These line profiles were analyzed using the modified Williamson-Hall method and the modified Warren-Averbach method to calculate the dislocation density. The modified Williamson-Hall method and the modified Warren-Averbach method are known methods, and their details are described, for example, in T. Ungar and A. Borbely, "The effect of dislocation contrast on x-ray line broadening: A new approach to line profile analysis", Appl. Phys. Lett., vol. 69, no. 21, p. 3173, 1996, and in T. Ungar, S. Ott, P. Sanders, A. Borbely, J. Weertman, "Dislocations, grain size and planar faults in nanostructured copper determined by high resolution X-ray diffraction and a new procedure of peak profile analysis", Acta Mater., vol. 46, no. 10, pp. 3693-3699, 1998. For the X ray source, synchrotron radiation was adopted. A Si (111) plane double-crystal monochromator and a Pt (platinum) coated mirror were used. The X-ray incident angle was 2.5 mrad, and the X-ray wavelength was 0.0689 nm (energy: 18.0 keV). A NaI scintillation counter was used as a detector. The scanning method adopted was 2θ-θscan. The entrance slit had a width of 4 mm and a height of 0.5 mm, and the light-receiving slit was a double slit (with a width of 4 mm and a height of 0.5 mm). The measurement conditions were set such that there are nine or more measurement points within the full width at half maximum of each diffraction peak, the peak intensity is 2000 counts or more, and the measurement range is about ten times the full width at half maximum.

The tensile test was conducted in accordance with JIS Z 2241. The relationship between dislocation density and tensile strength obtained from the experiments is shown in FIG. 3.

Figure 3:
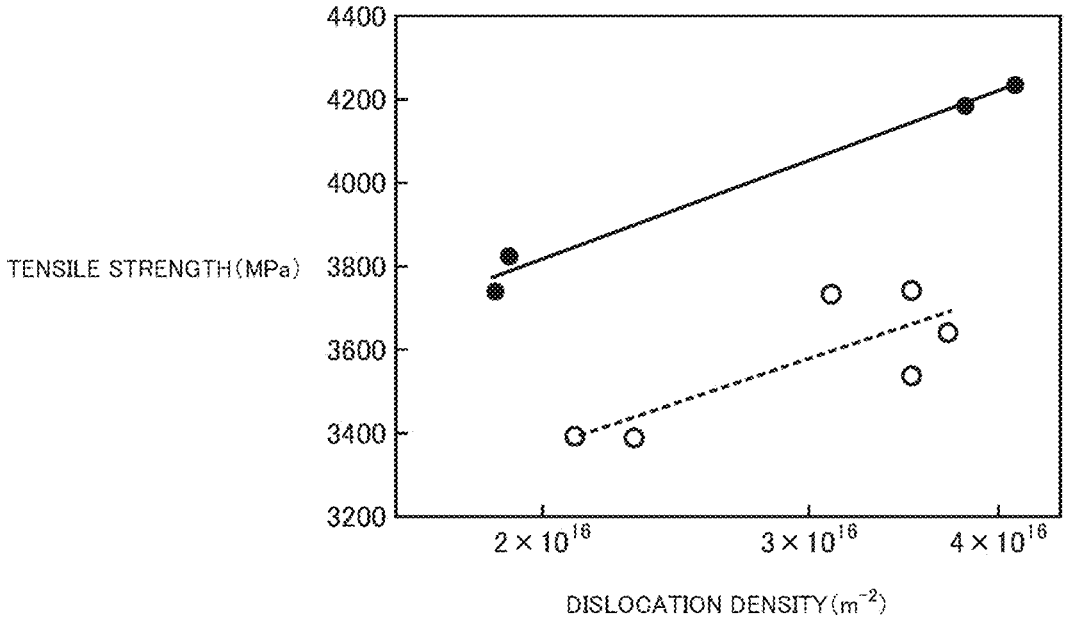
FIG. 3 is a diagram illustrating a relationship between dislocation density and tensile strength.

In FIG. 3, the horizontal axis corresponds to the dislocation density. The vertical axis corresponds to the tensile strength. The solid circles are data points for the steel wires produced from the raw material wire A. The hollow circles are data points for the steel wires produced from the raw material wire B. The solid and broken lines indicate the relationship between dislocation density and tensile strength in the raw material wires A and B, respectively.

Referring to FIG. 3, it is confirmed that the tensile strength increases with increasing dislocation density. It can be seen that a high tensile strength of 4000 MPa or more can be achieved by using a raw material wire with the carbon content of 1.0 mass % or more and by setting the dislocation density to $2.4\times10^{16}$ $m^{-2}$ or more.

(2) Relationship Between Full Width at Half Maximum and Toughness

Steel wires were produced using the raw material wire A with the same procedure as in (1) above. At this time, Sample 1 was produced with a heating temperature of 665° C. and a hold time of 10 seconds in step S40, Sample 2 was produced with a heating temperature of 600° C. and a hold time of five seconds, and Sample 3 was produced by omitting the step S40. Sample 4 was also produced by setting the reduction of area in the first wire drawing step to be smaller than those of Samples 1 to 3 and by omitting the step S40. For each sample, the full width at half maximum was measured and toughness was evaluated.

The measurement of the full width at half maximum was performed using an X-ray residual stress analyzer (model number: μ-X360s) manufactured by Pulstec Industrial Co., Ltd. Using a Cr tube as an X-ray source, the full width at half maximum in the circumferential direction at a peak of a maximum intensity of a Debye ring for Fe (211) plane was calculated under the condition that, with the longitudinal direction of the steel wire aligned with the incident direction, the angle made by the surface of the steel wire and the X-ray incident direction is 35 degrees (incident angle: 35 degrees). Specifically, the full width at half maximum was calculated using the following procedure. Firstly, for the Debye ring for Fe (211) plane obtained under the above condition, a point corresponding to a peak of a maximum intensity was identified. Next, for a circle passing through this point and concentric with the Debye ring, the peak intensities were examined in the circumferential direction. Then, the angle between two points corresponding to half the intensity of the maximum intensity peak was calculated as the full width at half maximum (angle). The evaluation of toughness was conducted by bunching four brass-plated steel wires with a wire diameter of 0.30 mm and stranding them together under the same conditions using a buncher stranding machine, and by measuring the number of times of wire breakage per ton of the steel wire. The experimental results are shown in Table 2.

TABLE 2

| | Full Width at Half Maximum (°) | Number of Wire Breakage (times/t) | Evaluation of Toughness | Dislocation Density ($\times10^{16}/m^{-2}$) |
|---|---|---|---|---|
| 1 | 72 | 4 | A | 4.1 |
| 2 | 43 | 15 | B | 4.3 |
| 3 | 35 | >30 | C | 3.8 |
| 4 | 82 | 3 | A | 1.9 |

For the evaluation of toughness in Table 2, considering the yield in mass production of steel cords, A was given to those with a favorable number of steel wire breakage, B to those with an acceptable number, and C to those for which improvement is desired. It should be noted that, as shown in Table 2, Samples 1 to 3 each have a dislocation density of $3.8\times10^{16}$ $m^{-2}$ to $4.3\times10^{16}$ $m^{-2}$.

Referring to Table 2, it can be seen that in Samples 1 to 3, despite the similar dislocation densities, there are differences in the number of wire breakage due to the differences in the full width at half maximum in the circumferential direction at the peak of the maximum intensity of the Debye ring for Fe (211) plane. It is confirmed that high toughness can be obtained in Samples 1 and 2 with the full width at half maximum of 42° or more. It is also confirmed that even higher toughness can be obtained in Sample 1 with the full width at half maximum of 60° or more. On the other hand, although the full width at half maximum can be easily increased by decreasing the reduction of area in the first wire drawing step, this causes the dislocation density to decrease to $1.9\times10^{16}$ $m^{-2}$ as in Sample 4. As a result, it is difficult to achieve a high tensile strength of, for example, 4000 MPa or more, as shown in FIG. 3.

As described above, the steel wire of the present disclosure is capable of achieving both high tensile strength and high toughness, and is therefore suitable for a steel wire constituting a steel cord, for example. The application of the steel wire of the present disclosure is not limited to the steel cords; it is applicable to cords for conveyors and cords for handrails, and also to wires for rubber reinforcement.

It should be understood that the embodiment and the examples disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1: steel wire; 11: outer peripheral surface; D: wire diameter, and S10, S20, S30, S40, S50: step.

The invention claimed is:

1. A steel wire composed of a steel containing:

not less than 1.0 mass % and not more than 1.1 mass % C, not less than 0.15 mass % and not more than 0.25 mass % Si, not less than 0.25 mass % and not more than 0.35 mass % Mn, and not less than 0.15 mass % and not more than 0.25 mass % Cr, with the balance being Fe and unavoidable impurities;

the steel wire having a wire diameter of not less than 0.15 mm and not more than 0.42 mm, the steel having a pearlitic microstructure formed by patenting, wherein the patenting includes austenitizing at a temperature Acm or higher and then isothermal transformation to obtain a fine pearlite structure;

the steel having a dislocation density of not less than $2.4\times10^{16}$ $m^{-2}$ and not more than $5.0\times10^{16}$ $m^{-2}$, the dislocation density being determined from X-ray diffraction line-profile analysis of Fe (110), (200), (211), (220), and (310) reflections using a synchrotron radiation source and calculated by the modified Williamson-Hall method and the modified Warren-Averbach method; and the steel having a full width at half maximum in a circumferential direction of not less than 42° at a peak of a maximum intensity of a Debye ring for Fe (211) plane, the full width at half maximum being measured using an X-ray residual-stress analyzer with a Cr tube while aligning the wire axis with the incident direction and setting an incident angle of 35°, and determined as the angular distance between half-maximum points on a circle concentric with the Debye ring that passes through the maximum-intensity peak.

2. The steel wire according to claim 1, wherein the full width at half maximum is not less than 60° and not more than 90°.

3. The steel wire according to claim 2, wherein the dislocation density is not less than $3.0\times10^{16}$ $m^{-2}$ and not more than $5.0\times10^{16}$ $m^{-2}$, the wire diameter is not less than 0.15 mm and not more than 0.18 mm, and the steel wire has a tensile strength measured in accordance with JIS Z 2241 of not less than 4240 MPa and not more than 4900 MPa.

4. The steel wire according to claim 2, wherein the dislocation density is not less than $3.0\times10^{16}$ $m^{-2}$ and not more than $8.0\times10^{16}$ $m^{-2}$ the wire diameter is not less than 0.18 mm and not more than 0.21 mm, and the steel wire has a tensile strength measured in accordance with JIS Z 2241 of not less than 4180 MPa and not more than 4740 MPa.

5. The steel wire according to claim 2, wherein the dislocation density is not less than $3.0\times10^{16}$ $m^{-2}$ and not more than $5.0\times10^{16}$ $m^{-2}$, the wire diameter is not less than 0.21 mm and not more than 0.30 mm, and the steel wire has a tensile strength measured in accordance with JIS Z 2241 of not less than 4000 MPa and not more than 4580 MPa.

6. The steel wire according to claim 1, wherein the dislocation density is not less than $3.0\times10^{16}$ $m^{-2}$ and not more than $5.0\times10^{16}$ $m^{-2}$.

7. The steel wire according to claim 1, wherein the wire diameter is not less than 0.15 mm and not more than 0.18 mm, and the steel wire has a tensile strength measured in accordance with JIS Z 2241 of not less than 4240 MPa and not more than 4900 MPa.

8. The steel wire according to claim 1, wherein the wire diameter is not less than 0.18 mm and not more than 0.21 mm, and the steel wire has a tensile strength measured in accordance with JIS Z 2241 of not less than 4180 MPa and not more than 4740 MPa.

9. The steel wire according to claim 1, wherein the wire diameter is not less than 0.21 mm and not more than 0.30 mm, and the steel wire has a tensile strength measured in accordance with JIS Z 2241 of not less than 4000 MPa and not more than 4580 MPa.

10. The steel wire according to claim 1, wherein the isothermal transformation is performed at 500° C. to 600° C.

* * * * *